US005263656A

United States Patent [19]

Raasch

[11] Patent Number: 5,263,656

[45] Date of Patent: Nov. 23, 1993

[54] BOBBIN TUBE RECEIVER

[75] Inventor: Hans Raasch, Muenchengladbach, Fed. Rep. of Germany

[73] Assignee: W. Schlafhorst AG & Co., Muenchengladbach, Fed. Rep. of Germany

[21] Appl. No.: 922,055

[22] Filed: Jul. 29, 1992

[30] Foreign Application Priority Data

Jul. 30, 1991 [DE] Fed. Rep. of Germany ..... 4125107

[51] Int. Cl.[5] ..... B65H 54/02

[52] U.S. Cl. ..... 242/18 PW

[58] Field of Search ..... 242/18 PW, 18 DD, 129.51

[56] References Cited

U.S. PATENT DOCUMENTS

| | | | |
|---|---|---|---|
| 2,998,202 | 8/1961 | Keith et al. | 242/18 PW |
| 3,559,903 | 2/1971 | McDermott et al. | 242/18 PW |
| 3,838,828 | 10/1974 | Hautemont | 242/18 DD |
| 4,102,507 | 7/1978 | Hoffmann et al. | 242/18 PW |
| 4,154,411 | 5/1979 | Kamp et al. | 242/18 PW X |
| 5,158,241 | 10/1992 | Dammann et al. | 242/18 PW |

FOREIGN PATENT DOCUMENTS

| | | |
|---|---|---|
| 7300246 | 1/1973 | Fed. Rep. of Germany . |
| 2506291A1 | 8/1976 | Fed. Rep. of Germany . |
| 2541761A1 | 3/1977 | Fed. Rep. of Germany . |
| 2500820 | 9/1982 | France . |

*Primary Examiner*—Stanley N. Gilreath

*Attorney, Agent, or Firm*—Shefte, Pinckney & Sawyer

[57] ABSTRACT

A receiver for supporting one end of a bobbin tube in a spinning or bobbin winding machine has a tube-engaging plate member with a nose member mounted on the plate member for movement between a normal resting position and an operating position A yarn delivery device guides the yarn into the range of movement of the nose member. A contoured yarn clamping surface and a contoured yarn guide surface are formed on the plate member. The nose member initially catches the yarn and clamps it on the clamping surface, drawing the yarn end out of the delivery device, and then guides the yarn via the yarn guide contour in the direction of the middle of the bobbin tube. The nose member is thereby surrounded by a loop of the yarn and extends over the foot end of the tube in the direction of lengthwise the middle of the tube to orient the yarn loop adjacent to the winding area for the yarn reserve windings.

3 Claims, 5 Drawing Sheets

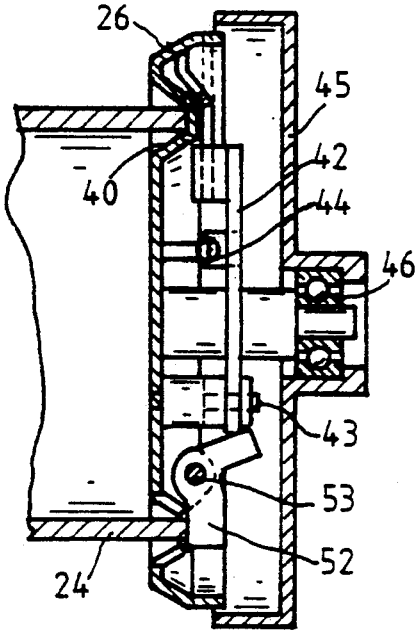
FIG. 6
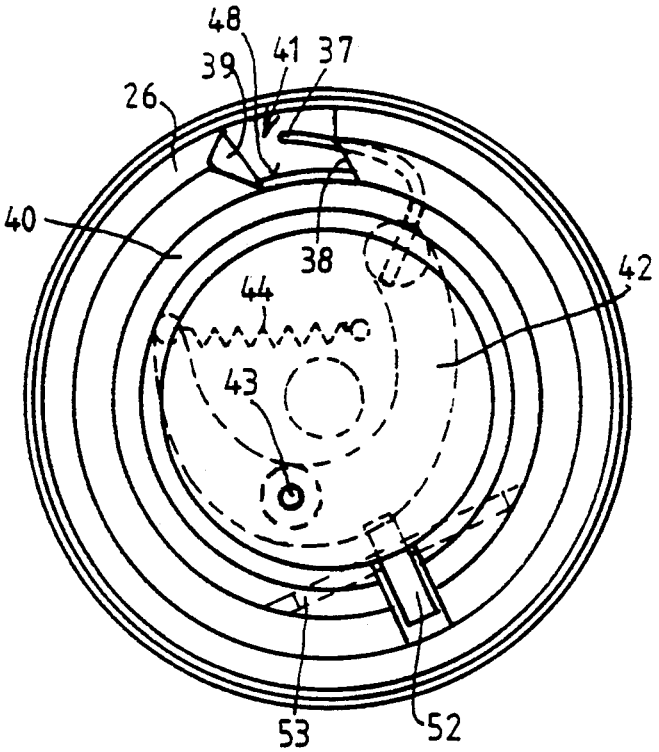
FIG. 5
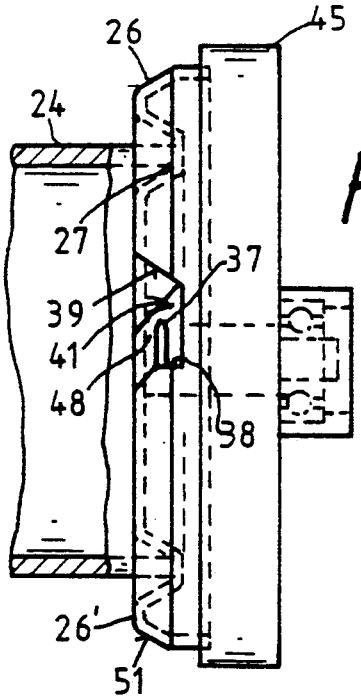
FIG. 7
FIG. 8
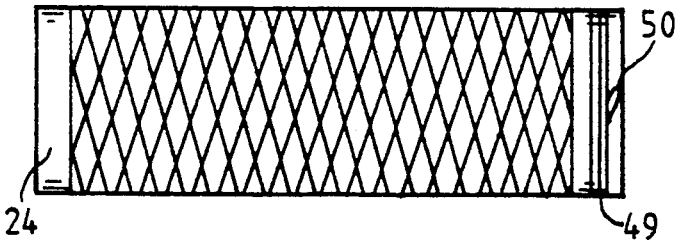

BOBBIN TUBE RECEIVER

BACKGROUND OF THE INVENTION

The present invention relates to a bobbin tube receiver for a textile spinning or winding machine and, more particularly, to an improvement in a bobbin tube receiver of the type disclosed in German Gebraushmuster 73 00 246.

In textile winding operations wherein a yarn is to be rewound onto a bobbin tube, it is necessary not only to catch the leading yarn end but also in many instances to fix the yarn end on the tube foot in the form of a yarn reserve that can be readily removed by hand. German DE-A 25 06 291 suggests to this end, for example, that the yarn end caught by a catch nose member be overwound by a yarn reserve. Then, during further processing of the completely wound bobbin tube, the yarn end can be grasped by hand and joined to the leading yarn end of a following bobbin.

The automatic receipt of the yarn end by the bobbin tube is explained in an embodiment in German DE-A 25 06 291 for the production of starter bobbins for open end spinning machines. However, the catching of the yarn end and the placing of a yarn reserve which overwinds the yarn end are also known in cheese changers in automatic bobbin winding machines like those known from German DE 37 33 353 A1. In both devices, the tube to be rewound is wound with the yarn reserve outside of the bobbin receiver of the winding head and, after this operation has taken place, the tube is transferred to the actual tube receiver of the machine.

High demands are placed on the yarn reserve and the ability to grasp the yarn end. On one hand, the yarn reserve should be wound sufficiently firmly on the tube foot that it does not come loose during transportation and handling of the finished bobbins. On the other hand, the yarn end must be able to be readily grasped and removed from the tube foot. Moreover, the yarn end should not be damaged in order that it does not cause any errors during further processing.

It can occur in the known devices that the leading yarn end is incorrectly clamped on the side of the tube because of yarn tension fluctuations, which causes the yarn end to come loose during winding and wrap around the tube so that the yarn end is wound into the bobbin. It can also occur that the clamped yarn end is rubbed apart during winding by means of a slight relative motion between the tube and the tube carrier. The yarn reserve can then come loose and be lost or difficult to find. When a catch nose is used, the length of the free yarn end is not optimally controlled and, if it is too long, can whip into the yarn windings.

SUMMARY OF THE INVENTION

The present invention has the object of providing a bobbin tube receiver which permits a reliable fixing of the yarn reserve and at the same time makes possible a ready location and removal of the yarn end, thereby avoiding the above-mentioned disadvantages of conventional bobbin tube receivers.

The present invention achieves the foregoing objective by providing a receiver for supporting a foot end of a bobbin tube in a textile spinning or bobbin winding machine, which receiver is equipped with a rotatable tube engaging plate member and a nose member mounted on the plate member for movement between an inoperative resting position and an operating position for catching a yarn to be wound onto the bobbin tube. According to the present invention, a yarn delivery device is provided for guiding a yarn into the range of movement of the nose member. The plate member has a yarn clamping surface and a yarn guide surface associated with the nose member. The clamping surface is disposed for clamping of the yarn with the nose member in the operating position thereof to grasp the yarn and withdraw it from the yarn delivery device. The guide surface is disposed for directing the grasped yarn toward the middle of the bobbin tube to cause the yarn to surround the nose member in a loop at a location adjacent the foot end of the bobbin tube. In this manner, the yarn loop can be readily secured by the subsequent formation of reserve windings of the yarn over the loop about the foot end of the bobbin tube.

The plate member preferably includes an outer edge for receiving and centering the foot end of the tube. The outer edge is configured to extend over the foot end of the tube and includes a beveled surface extending toward the middle of the tube. The nose member is arranged adjacent the beveled surface and the plate member is provided with another guide surface, which is behind the nose member in the direction of rotation of the plate member, for guiding the yarn essentially toward the middle of the bobbin tube In the device of the present invention, the yarn loop is kept relatively small because the arrangement of the nose member to overlap the area of the foot end of the bobbin tube whereat the yarn reserve windings are formed and to extend in the direction of the tube middle causes the loop to lie on the tube. The yarn loop therefore does not extend over the end of the tube and is thus not exposed to any mechanical stresses imposed by the plate member or when the tube is set on its food end. On the other hand, the loop can be readily recognized and can then be readily drawn out by its free end from under the reserve windings of yarn. The design of the bobbin tube receiver of the invention enables it to be easily constructed since the yarn to be wound can be guided into the desired area by relatively simple contours on the plate member.

In order to make it possible to simply remove a starter tube or a fully wound bobbin prepared in this manner from the tube receiver without destroying the yarn loop, the nose member is arranged to move automatically from its resting position into its operating position upon insertion of the foot end of the tube into the plate member and then back to its resting position upon tube removal.

Specifically, the nose member is pivotably mounted to the plate member and a spring or other biasing member is provided for urging the nose member into its resting position. A movable lever is mounted to the plate member in a disposition to be moved by the foot end of the bobbin tube into engagement with the nose member to cause movement into its operating position.

BRIEF DESCRIPTION OF THE DRAWINGS

FIG. 5 is an end view of the bobbin tube receiver of FIG. 4;

FIG. 6 is a vertical cross-section through the bobbin tube receiver of FIG. 5;

FIG. 7 is a top side view of the bobbin tube receiver of FIG. 5; and

FIG. 8 is a side view of a starter bobbin produced according to the present invention with a leading end yarn loop, yarn reserve windings and starting cross-windings for use in producing a cross-wound bobbin of an open end spinning machine.

DESCRIPTION OF THE PREFERRED EMBODIMENT

Figure 1:
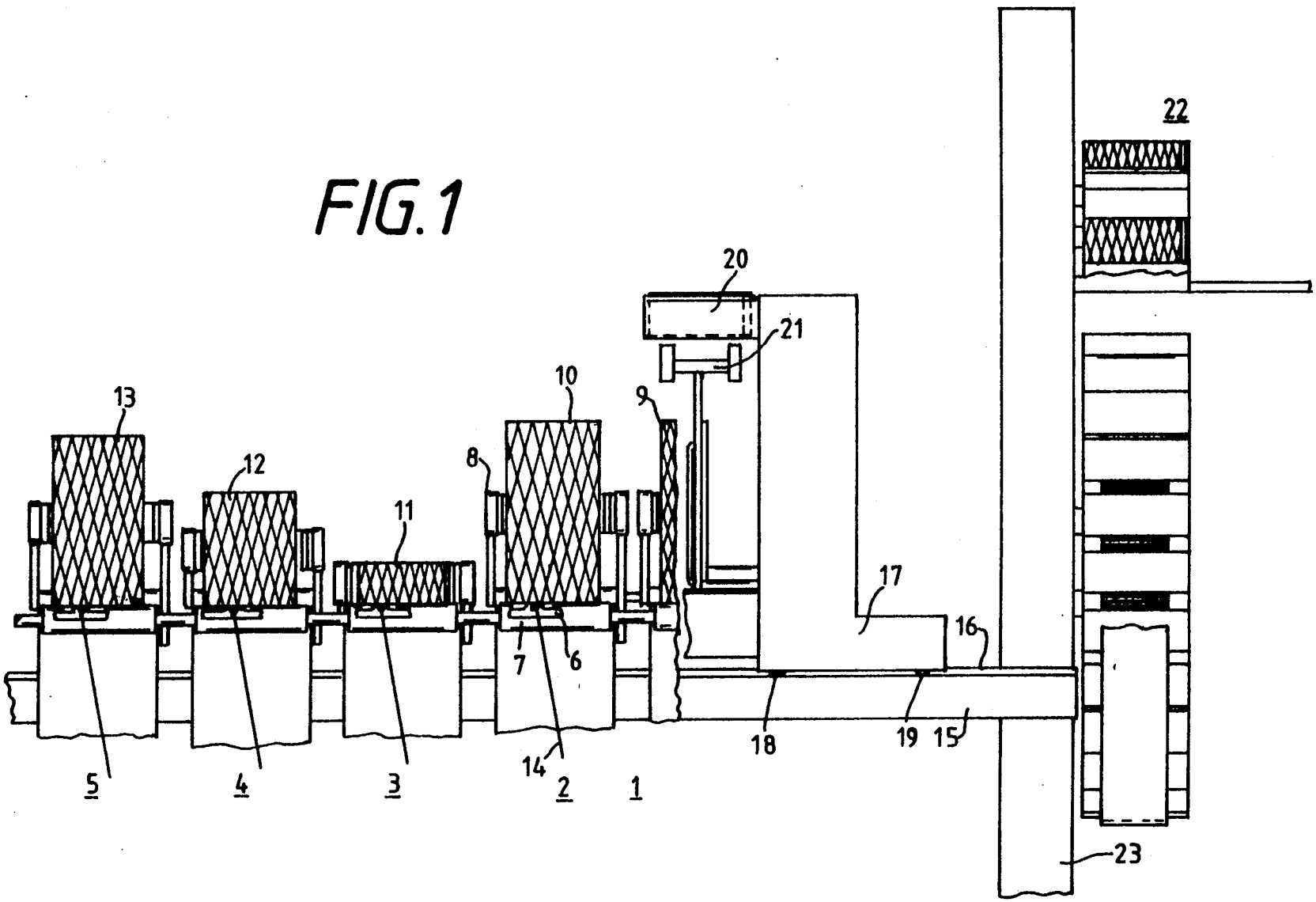
FIG. 1 shows a section of a bobbin winding machine encompassing several adjacent winding heads in which the bobbin tube receiver of the present invention may be embodied.

FIG. 1 shows a section of a bobbin winding machine which comprises a plurality of individual winding heads or stations of which only winding heads 1 to 5 are shown. Each winding head comprises a reciprocating yarn guide 6 traveling back and forth widthwise across its respective winding head, a winding roller 7 and a creel assembly 8 for supporting a bobbin tube in parallel surface contact with the winding roller 7. The winding heads 1 to 5 are illustrated with respective winding bobbins 9 to 13 at different stages of being wound to full capacity. As the bobbins are driven as hereinafter described, a yarn 14 is delivered onto the surface of each bobbin and thereby caused to be wound thereon. The winding machine further includes a machine frame 15 having a guide track 16 on which a bobbin changing device 17 can travel by means of rollers 18,19.

The bobbin changing device 17 includes a tube magazine 20 and a tube supply mechanism 21. A special winding device 22 is located at the end of the bobbin winding machine for producing starter bobbins for an open end spinning machine. The winding device 22 is of the type disclosed in German DE 25 06 291 A1, which is incorporated herein by reference.

Figure 2:
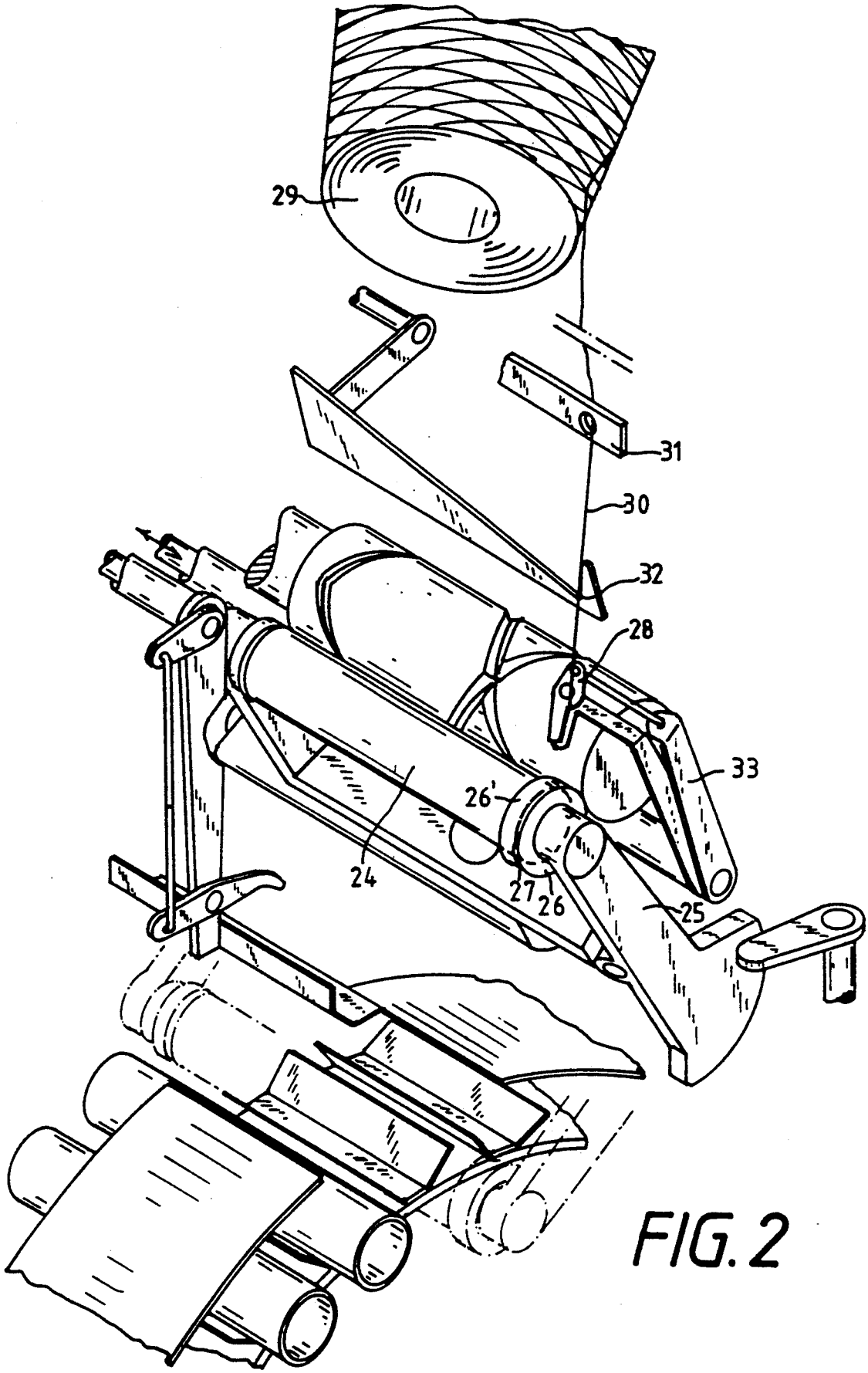
FIG. 2 is a perspective view of one winding head in an initial disposition for producing a reserve yarn winding.

As shown in FIG. 2, an empty tube 24 is clamped in the creel 8 by creel arm 25. An edge 26' of a tube carrier plate 26 extends over the foot portion 27 of the tube 24. A clamp shear 28 holds the leading end of a yarn 30 being unwound and fed from a bobbin 29. The yarn 30 is guided through a guide eyelet 31 and by a yarn lifter arm 32.

Figure 3:
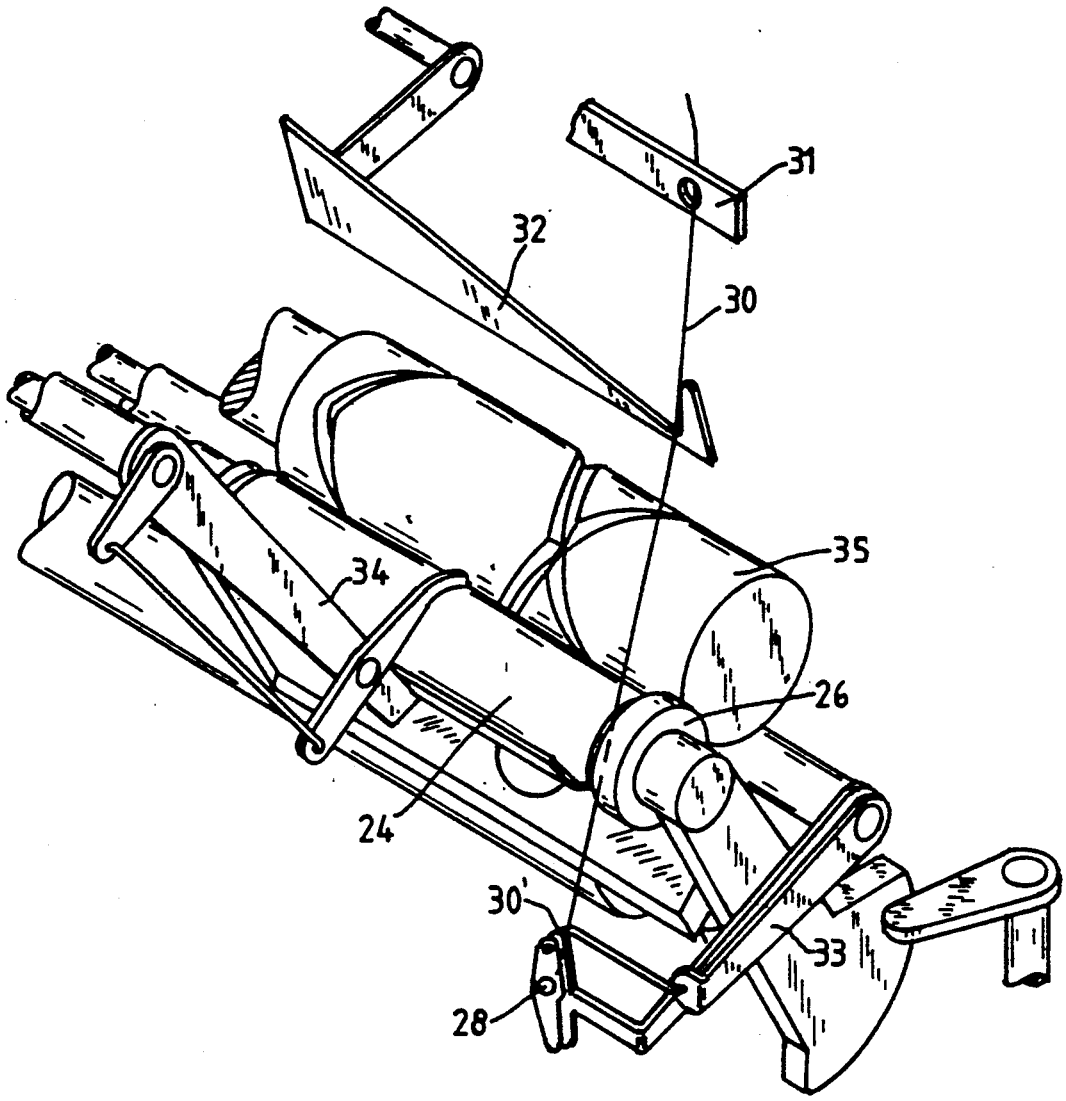
FIG. 3 is another perspective view of the winding head of FIG. 2 showing a leading end of yarn presented thereto for formation of reserve yarn windings.

The clamp shear 28 is mounted at the end of a pivotable support arm 33 which is movable from the yarn holding position of FIG. 2 to a yarn feeding position shown in FIG. 3. The process of catching and initiating winding of the leading end 30' of the yarn 30 begins after the release of the empty tube 24 by the tube placement assembly 34 and the driving of the tube 24 by a helically grooved winding drum 35.

Figure 4:
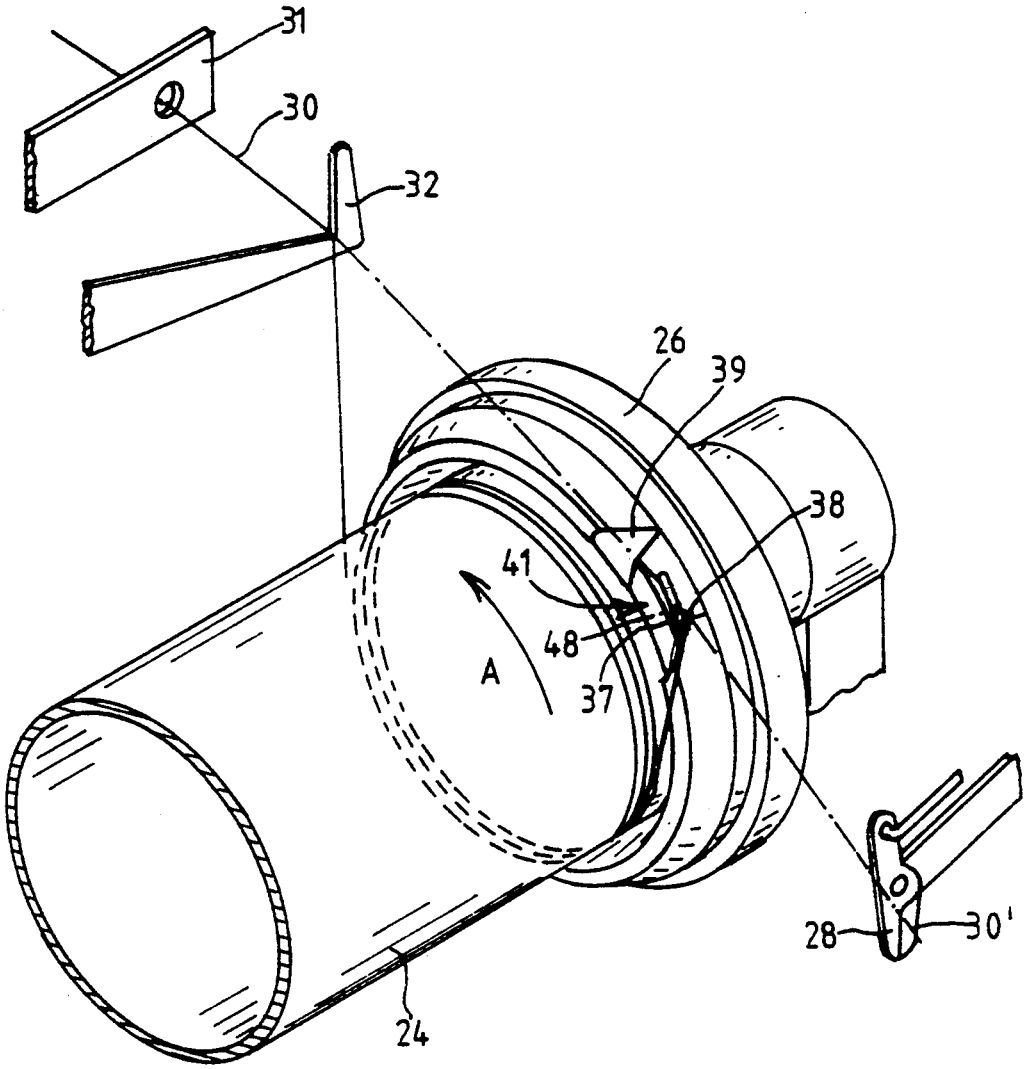
FIG. 4 is an enlarged perspective view of the bobbin tube receiver according to the present invention.

FIG. 4 shows the tube carrier plate 26 on an enlarged scale, wherein a catch nose member 37, a contoured clamping surface 38 and a contoured yarn guide surface 39 can be seen. The yarn 30 is shown in dotted lines in its initial position prior to being entrained by the catch nose member 37, whereas the solid line representation of yarn 30 shows its disposition after being engaged by the nose member 37 and wound in a few windings about the tube foot 27.

FIGS. 5–7 show the mechanical structure of the tube carrier plate 26 and its catch nose member 37 which enables it to be moved automatically between operating and rest positions.

In FIG. 5, an end view of the tube carrier plate 26 is shown. The empty tube 24 is centered in this embodiment in a V-shaped groove 40 formed in the tube plate 26. The catch nose member 37 extends through a recess 41 in the outer edge 26' of the tube carrier plate 26. The catch nose member 37 is fixed to the end of a crescent-shaped lever arm 42 which is rotationally mounted on a bolt 43 affixed to the tube carrier plate. A tension spring 44 is attached to the opposite end of the lever arm 42 to urge rotation of the lever arm 42 to withdraw the catch nose 37 from disposition within the recess 41 to a disposition behind the contour of the tube carrier plate 26. Another lever arm 52 in the shape of a bell crank is pivotably supported within the tube carrier plate 26 on a shaft 53, which is mounted to the tube carrier plate 26, with the lever arm 52 in contact with the lever arm 42 for actuating pivotal movement thereof against the spring 44.

As will be recognized in FIG. 6, the foot end of the empty tube 24, when centered in the V-shaped groove 40 of the tube carrier plate 26, presses against the angled lever arm 52 to pivot it counterclockwise (as viewed in FIG. 6) which causes the lever arm 42 to be lifted and the catch nose 37 thereby to be thrust counter to the action of the tension spring 44 to project into the recess 41. It can also be recognized in FIG. 6 that the tube carrier plate 26 is rotatably mounted in a receiver sleeve 45 by a ball bearing assembly 46.

As shown in FIG. 7, the tube carrier plate 26 extends slightly over the foot end of the empty tube 24 with the catch nose member 37 also extending over the tube 24. The recess 41 in the tube carrier plate 26 is configured and designed so that the yarn 30 to be wound on the tube 24 can slide behind catch nose member 37 when placed on the tube 24 and be clamped between the catch nose member 37 and an adjacent contoured clamping surface 38 of the tube carrier plate 26. The yarn 30 is guided on a contoured sliding surface 48 located under the catch nose member 37 so that the yarn 30 becomes bent at a right angle on the facing side of the tube carrier plate 26 and is wound onto the tube 24 close to such side of the tube carrier plate 26. An outer bevel or chamfer 51 on the tube carrier plate 26 supports the precise placement of the yarn 30 on the tube 24.

FIG. 8 shows the tube 24 wound with the yarn 30, including a series of yarn reserve windings 49, from which a loop 50 of the yarn 30 extends. As a result of the contour of the outer edge 26' of the tube carrier plate 26 which extends over the tube 24 and the position of catch nose 37, the yarn loop 50 lies on the end of the tube 24 and, because of the firm binding of the loop 50 by the other reserve windings, it cannot slide into the interior of the tube 24.

The method of operation of the described embodiment of the invention may thus be understood. As seen in FIG. 2, the leading end of the yarn 30 is placed into the clamping shear 28 via a yarn supply mechanism (not shown). The yarn 30 also extends over the lowest point on the yarn lifter arm 32 at its outer end. The support arm 33 carrying the clamping shear 28 is moved into the feed position of FIG. 3 thereby tensioning the yarn 30 transversely over the tube carrier plate 26. After the tube placement assembly 34 has delivered a tube 24 to the creel 8 and is pivoted away from the empty tube 24, the grooved yarn winding drum 35 begins to rotate and, in turn, drives rotation of the tube 24 in the direction of arrow A in FIG. 4.

The tube 24 upon placement into the V-shaped annular groove 40 actuates movement of the catch nose member 37 into its operative position projecting into the recess 41 by engagement of the lever 52, as can be seen from FIG. 4. The catch nose member 37 thereby intersects the path of the yarn 30 tensioned over the tube carrier plate 26, shown in the broken line in FIG. 4, and clamps the yarn between itself and the contoured clamping surface 38. As a result thereof, the yarn is drawn out of the clamping shear 28. During further rotation of the tube 24, the yarn 30 is directed by the contoured sliding surface 48 in the direction of the lengthwise middle of the tube, causing the yarn to be formed in a loop 50 about the catch nose member 37. After the yarn has thus been grasped and a complete rotation of the tube occurred, the winding of the yarn reserve begins, at which time the yarn 30 is directed onto the tube 24 via the bevel 51 of the tube carrier plate 26 to form windings of the yarn over the yarn loop 50 held by the catch nose 37. After a selected number of such overwindings, the yarn lifter arm 32 is lowered, permitting the yarn 30 to contact the surface of the yarn guide drum 35 and settle into its helical groove so that, thereafter, a normal cross-winding process proceeds until the bobbin is wound to its full capacity or, if it is desired to produce a starter bobbin such as for open end spinning operations, the winding process can be interrupted after a few cross-wound layers in order that the bobbin can be removed as a starter bobbin.

As initially mentioned, the invention can also be used with advantage in bobbin changers in automatic cheese windings in which the reserve yarn winding is produced in the changer using the yarn last wound onto a cross-wound bobbin which is then to be changed.

Advantageously, the yarn loop 50 is securely held in the area of the tube 24 and is not exposed to any mechanical stresses. In addition, it can be readily found and drawn out from under the reserve windings. The yarn reserve windings with the loop so formed in accordance with this invention thus fulfills the requirements of presenting the yarn end in an undamaged form and of being readily manipulable in further bobbin or yarn processing.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In a device fore rewinding yarn onto a bobbin tube, the device being of the type having a yarn delivery device for guiding a yarn from a yarn package to be rewound into a receipt position for subsequent receipt and guiding of the yarn onto a bobbin, a bobbin tube receiver for supporting a foot end of a bobbin tube in a textile spinning or bobbin winding machine, said bobbin tube receiver having a rotatable tube engaging plate member, a nose member mounted on said plate member for catching a yarn to be wound onto the bobbin tube, said nose member being movable between an inoperative resting position and an operating position, said nose member for receiving a yarn guided by the yarn delivery device into the range of movement of said nose member, said plate member having a yarn clamping surface and a yarn guide surface associated with said nose member, said clamping surface being disposed for clamping of the yarn with said nose member in the operating position thereof to grasp the yarn and withdraw it from said yarn delivery device and said guide surface being disposed for directing the grasped yarn toward the lengthwise middle of said bobbin tube to cause the yarn to surround said nose member in a loop at a location adjacent said foot end of said bobbin tube for securement of the yarn loop by reserve windings of the yarn wound thereabout.

2. A bobbin tube receiver according to claim 1, wherein said plate member comprises an outer edge for receiving and centering said foot end of said tube, said outer edge being configured to extend over said foot end of said tube and said outer edge comprising a beveled surface extending toward the middle of said bobbin tube, said nose member being arranged adjacent said beveled surface and said plate member having another guide surface which is behind said nose member in the direction of rotation of said plate member for guiding the yarn essentially toward the middle of said bobbin tube.

3. A bobbin tube receiver according to claim 1, wherein said nose member is pivotably mounted and further comprising biasing means for urging said nose member into its said resting position and a movable lever mounted to said plate member in a disposition to be moved by the foot end of said bobbin tube into engagement with said nose member to cause movement thereof into its said operating position.

* * * * *